US006619187B2

(12) United States Patent
Plaga

(10) Patent No.: US 6,619,187 B2
(45) Date of Patent: Sep. 16, 2003

(54) RADIAL PISTON PUMP

(75) Inventor: Kurt Plaga, Herne (DE)

(73) Assignee: ATS Spartec Inc., Burlington (CA)

( * ) Notice: Subject to any disclaimer, the term of this patent is extended or adjusted under 35 U.S.C. 154(b) by 95 days.

(21) Appl. No.: 09/990,575

(22) Filed: Nov. 21, 2001

(65) Prior Publication Data

US 2002/0081215 A1 Jun. 27, 2002

(30) Foreign Application Priority Data

Nov. 23, 2000 (DE) ..... 100 58 050

(51) Int. Cl.[7] ..... F01B 1/00
(52) U.S. Cl. ..... 92/72; 91/494
(58) Field of Search ..... 92/72; 91/494, 91/491, 187

(56) References Cited

U.S. PATENT DOCUMENTS 2,372,523 A * 3/1945 Sinclair ..... 92/72
2,709,422 A * 5/1955 Bray ..... 92/72
3,968,736 A * 7/1976 Pecorari ..... 92/72
5,400,594 A * 3/1995 Hayens ..... 92/72

* cited by examiner

*Primary Examiner*—Edward K. Look
*Assistant Examiner*—Michael Leslie
(74) *Attorney, Agent, or Firm*—Henry M. Feiereisen

(57) ABSTRACT

A radial piston pump has a support ring disposed on an eccentric longitudinal section of a pump shaft for rotation relative to the pump shaft. The support ring has at least three mutually offset flat support faces uniformly distributed about the circumference and adapted to contact piston shoes connected with pistons that extend radially from the pump shaft. The piston shoes engage from behind with radial flanges support rails disposed on the support ring. Spring-supported pressure rings prevent the piston shoes from rotating relative to the support ring. The pistons extend through guide bushing with an outside diameter that is greater than the diameter of the radial flanges and also greater than the outside diameter of the pressure rings.

8 Claims, 4 Drawing Sheets

RADIAL PISTON PUMP

CROSS REFERENCES TO RELATED APPLICATIONS

This application claims the priority of German Patent Application Serial No. 100 58 050.5, filed Nov. 23, 2000, the subject matter of which is incorporated herein by reference.

BACKGROUND OF THE INVENTION

The present invention relates to a radial piston pump, and more particularly to a radial piston pump adapted to pump corrosive fluids, such as clarified water.

In conventionally designed radial piston pumps, piston shoes are connected to pistons through ball-shaped heads and pressed by comparatively strong helical compression springs against flat support surfaces disposed on the outer circumference of a support ring. The support ring is arranged on an eccentric cylindrical longitudinal section of the pump shaft and can rotate relative to the pump shaft. The support ring has at least three support surfaces which are offset relative to one another by 120°. Depending on the number of pistons, the support ring can also have a larger number of support surfaces, for example five or seven support surfaces.

The radially outwardly directed forces are hereby transferred from the support surfaces to the piston shoes and hence also to the pistons, while the helical compressions springs ensure that the piston shoes remain pressed against the support surfaces when the pistons are displaced radially inwardly.

Helical compression springs can operate reliably for displacing both the piston shoes and the pistons inwardly as long as the radial piston pump is used for pumping non-corrosive fluids. However, helical compression springs used in pumps that are subjected to less benign fluids, such as clarified water or aqueous solutions containing only a small fraction of lubricants, can be subject to corrosion. Such radial piston pumps are employed, for example, in descaling systems or water-based hydraulic systems. This reduces the service life of the radial piston pumps. The maintenance intervals are also relatively short, which diminishes their overall economic viability.

It would therefore be desirable and advantageous to provide an improved radial piston pump, in particular for clarified water or an aqueous solution with a small fraction of lubricants, wherein the pistons can reliably move towards the pump shaft without raising concerns about corrosion problems.

SUMMARY OF THE INVENTION

According to one aspect of the invention, a radial piston pump has a support ring that is disposed on an eccentric longitudinal section of a pump shaft and can rotate relative to the pump shaft. The support ring includes at least three mutually offset flat support faces which are uniformly distributed about the circumference of the support ring. The support faces contact piston shoes connected with pistons that extend radially from the pump shaft. The piston shoes have radial flanges that engage from behind support rails disposed on the support ring. In this way, the piston shoes remain in constant contact with the support faces disposed on the support ring. Also provided are spring-supported pressure rings which secure the piston shoes on the support ring against rotation thereto. The spring force has to be only large enough to press the piston shoes against the support faces in all operating positions. The spring force is only intended to compensate for unavoidable manufacturing tolerances.

Because the spring-supported pressure rings are now located in a region of the radial piston pump apart from the actual pumped medium, these components are likely not subject to corrosion.

The service life of the radial piston pump and the maintenance intervals are extended, while the pump also becomes more economical.

To facilitate assembly and disassembly of the piston shoes and the pistons as well as maintenance, the pistons extend through guide bushing with an outside diameter that is greater than the diameter of the radial flanges of the piston shoes and also greater than the outside diameter of the pressure rings. In this way, the piston and piston shoes including the pressure rings can be installed and removed through the bores for the guide bushings. In addition, the wall thickness of the guide bushings can be adapted to pistons with different diameters, so that the volumetric displacement of the radial piston pump can be readily changed. This arrangement also significantly simplifies the manufacture of different types of pumps.

Advantageously, the support rails have mutually parallel top and bottom surfaces and are arranged on the inside of two peripheral edge ribs disposed on the support ring. This arrangement significantly simplifies the manufacture of the peripheral edge ribs and of the support faces, since only simple straight milling operations are required. In all other aspects, the support ring represents a simple lathe-turned part.

According to another advantageous embodiment of the invention, each radial flange of the piston shoes is provided along its periphery with two mutually parallel opposing flat surfaces which are spaced apart from one another by a distance that is smaller than the distance between two opposing support rails. In this way, the piston shoes can be inserted during assembly while keeping the flat surfaces aligned parallel to the support rails until the piston shoes contact the support surfaces. Thereafter, the piston shoes only have to be rotated by 90°, so that the radial flanges engage the support rails from behind and thereby establish a tension-proof and pressure-proof coupling between the support ring and the piston shoes.

Conversely, for disassembly of the piston shoes, the piston shoes only have to be rotated by 90° until the flat faces are parallel to the support rails. The piston shoes can then be removed from the support ring in the radial direction.

According to yet another advantageous embodiment of the invention, the pressure rings include circumferential shoulders with a diameter that is smaller than the width of the support ring, but greater than the distance between two opposing support rails. In this way, the circumferential shoulders contact the support rails in the coupling position, which is the position where the support ring, pressure rings and piston shoes are coupled.

According to another advantageous embodiment of the invention, the pressure rings are provided with axial connecting pieces that are oriented away from the pump shaft. The circumferential shoulders have opposing mutually parallel flat surfaces with a spacing therebetween that is equal to the distance between two opposing support rails when a joining clearance is taken into consideration. In the coupling position, the flat surfaces engage between the piston shoes and the support rails and thereby determine the position of the piston shoes.

Advantageously, rotation between the parts is prevented by providing in the end faces of the circumferential shoulders transverse grooves which cooperate with radially extending attachment pins that are secured in the piston shoes adjacent to the radial flanges.

According to yet another advantageous embodiment of the invention, the pressure rings are pressed against the support rails by pressure springs, in particular helical compression springs, disposed between the pressure rings and the guide bushings.

The radial piston pump can be assembled as follows:

First, the piston shoes, with the pistons already connected, are inserted through the bores in the pump housing that receive the guide bushings until the piston shoes contact the support surfaces, while at the same time the flat faces on the radial flanges are kept aligned parallel to the support rails. The piston shoes are then rotated by 90°, so that the radial flanges engage the support rails from behind. Thereafter, the pressure rings are inserted through the ring gaps between the pistons and the walls of the bores in such away that the flat faces on the circumferential shoulders on aligned parallel with the support rails, so that the flat faces engage between the piston shoes and the support rails. In addition, the transverse grooves engage with the attachment pins, thereby reliably preventing the piston shoes from rotating relative to the support ring. Subsequently, the pressure springs are installed and the guide bushings are inserted into the bores until they contact a stop disposed on the inside end of the bores. The pressure springs are centered on the axial connecting pieces of the pressure rings and on the connecting pieces of the guide bushings.

The radial piston pump is disassembled in the reverse order.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
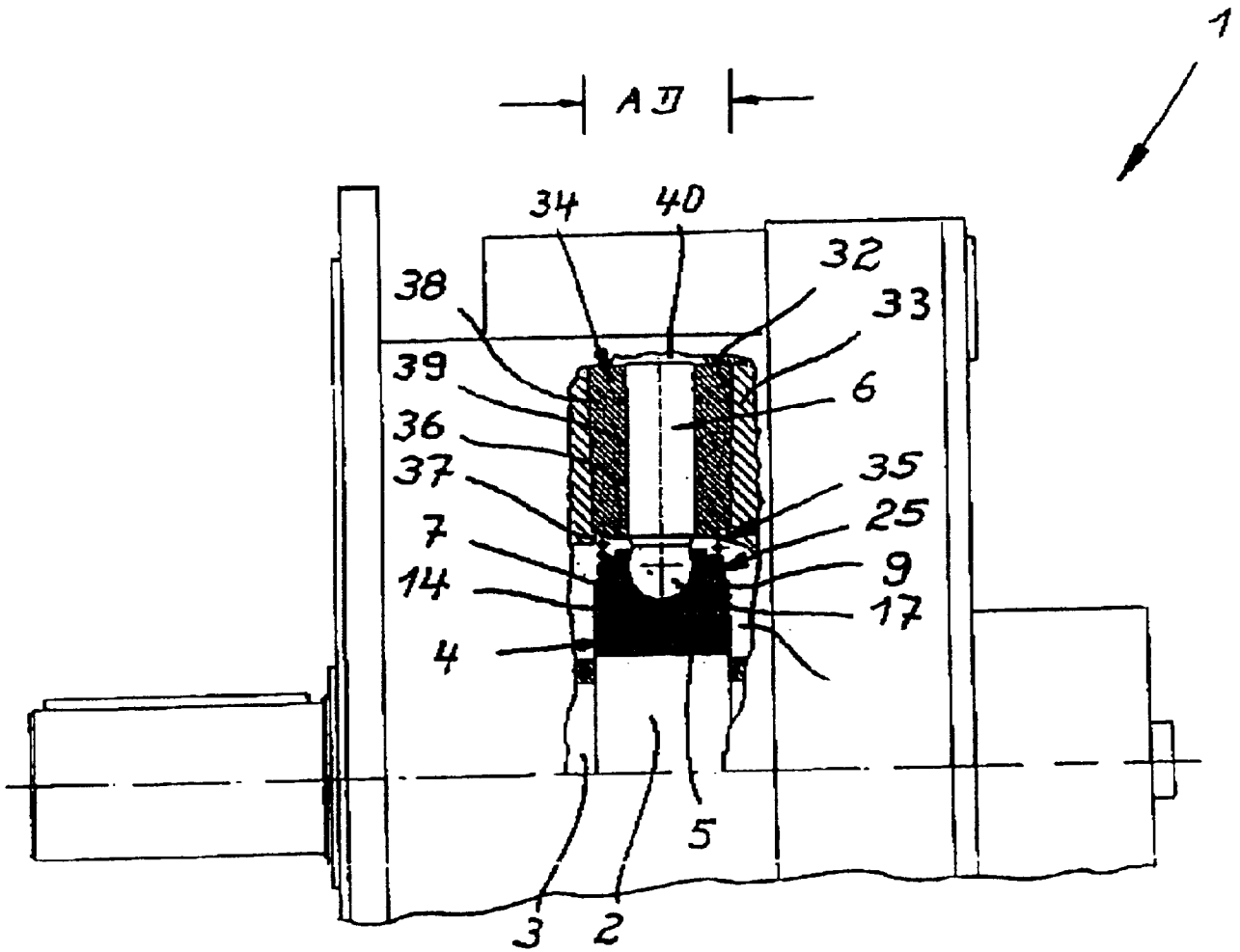
FIG. 1 shows schematically a partial side view and a partial longitudinal cross-sectional view of a radial piston pump for pumping clarified water.

Throughout all the Figures, same or corresponding elements are generally indicated by same reference numerals.

Figure 2:
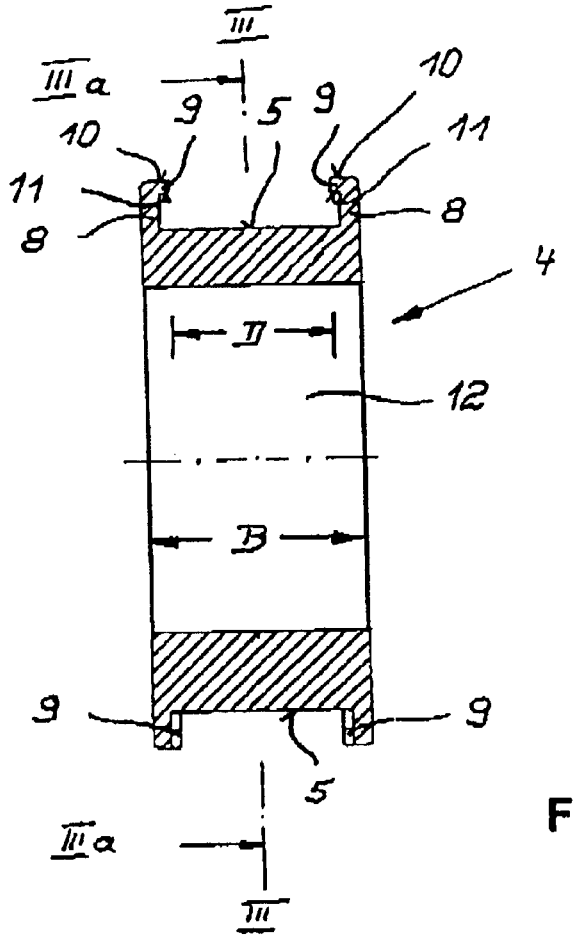
FIG. 2 shows an enlarged vertical longitudinal section of a support ring of the radial piston pump of FIG. 1.
Figure 3:
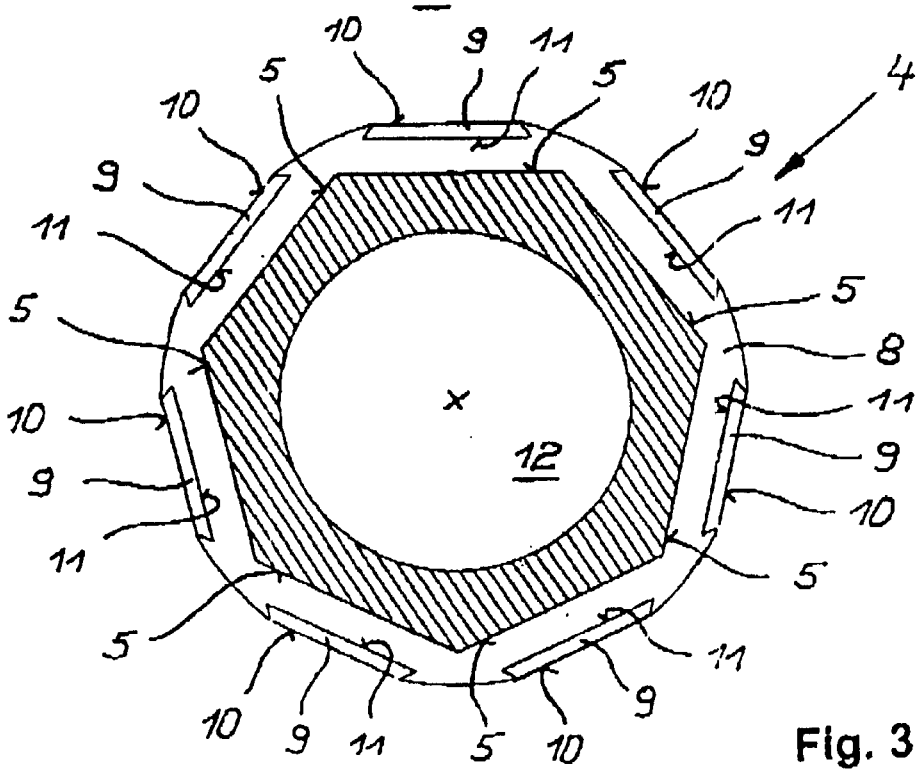
FIG. 3 shows a vertical cross-section along the line III—III of FIG. 2 as viewed in the direction of arrows IIIa.

Turning now to the drawing, and in particular to FIG. 1, there is shown an exemplary radial piston pump for pumping clarified water, generally designated by reference numeral 1 and including a support ring 4 which is disposed on an eccentric cylindrical longitudinal section 2 of a pump shaft 3. The support ring 4 can rotate relative to the pump shaft 3 (see also FIGS. 2 and 3). The support ring 4 has seven flat support surfaces 5 arranged along its periphery and adapted to contact piston shoes 7, 7*a* which are connected in a tension-proof and compression-proof manner with pistons 6 that extend radially from the pump shaft 3 (see FIGS. 4 to 6).

The support ring 4 has two opposing edge ribs 8 which project radially outwardly relative to the support surfaces 5. Support rails 9 with mutually parallel top sides 10 and bottom sides 11 are provided on the inside of the edge ribs 8. The support rails 9 also extend parallel to the support faces 5. The bore 12 in the support ring 4 is matched to the cylindrical longitudinal section 2.

Figure 4:
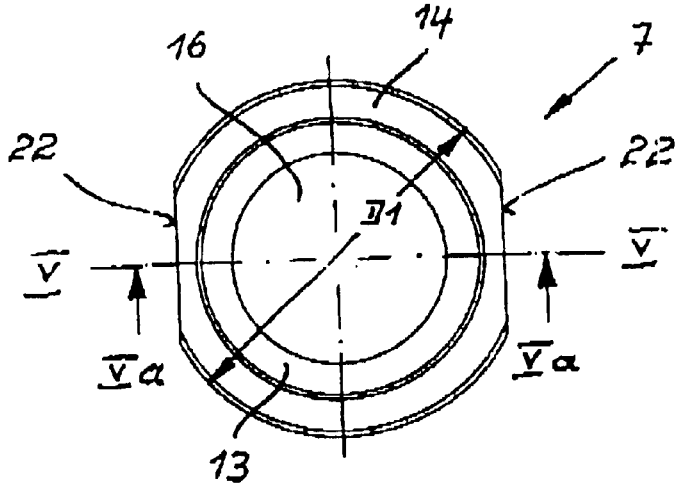
FIG. 4 shows an enlarged top view of a piston shoe of the radial piston pump of FIG. 1.
Figure 5:
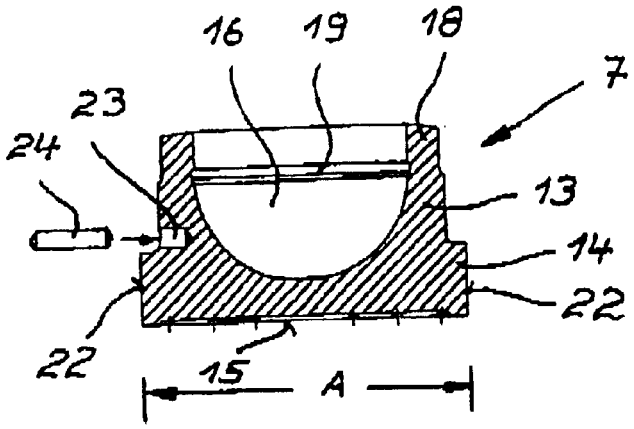
FIG. 5 shows a cross-sectional view along the line V—V of FIG. 4 as viewed in the direction of arrows Va.

Seven piston shoes 7 can be coupled to the support ring 4, as depicted in FIGS. 1, 4 and 5. The piston shoes 7 have cylindrical connecting pieces 13 and radial flanges 14. The end faces 15 of the piston shoes are provided with grooves and contact the support faces 5 of the support ring 4. On the inside, the piston shoes 7 have spherical cups 16 adapted to receive the ball-shaped heads 17 of the pistons 6.

In the embodiment depicted in FIGS. 4 and 5, the ball-shaped heads 17 are secured in the spherical cups 16 by bending the ends 18 of the connecting pieces 13 about the ball-shaped heads 17, as shown in FIG. 1. For this purpose, bending grooves 19 are provided on the inside of the piston shoes 7.

Figure 6:
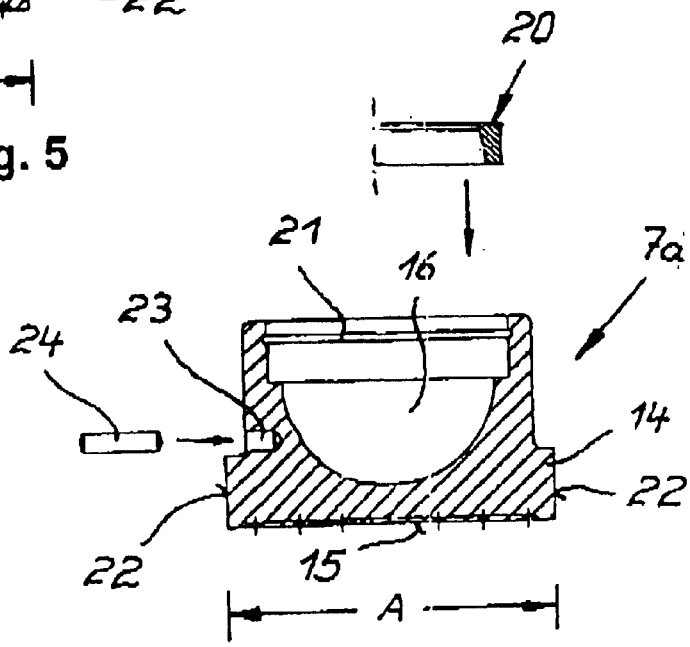
FIG. 6 shows a vertical cross-sectional view, similar to that of FIG. 5, of another embodiment of a piston shoe with an attachment ring.

FIG. 6 on the other hand shows an embodiment, wherein the position of the ball-shaped heads 17 in the piston shoes 7*a* is secured by suitable attachment rings 20 disposed on the inside to the ball-shaped heads 17 as well as by tension rings (not shown) that can be inserted into inner circumferential grooves 21.

The radial flanges 14 of the piston shoes 7, 7*a* have along their periphery two opposing parallel flat surfaces 22. The distance A between these flat surfaces 22 is smaller than the distance D (see FIG. 2) between two opposing support rails 9. This only represents a joint clearance.

As also seen in FIGS. 5 and 6, transverse bores 23 into which attachment pins 24 can be inserted, are provided adjacent to the radial flanges 14 in the connecting pieces 13 of the piston shoes 7, 7*a*.

Figure 7:
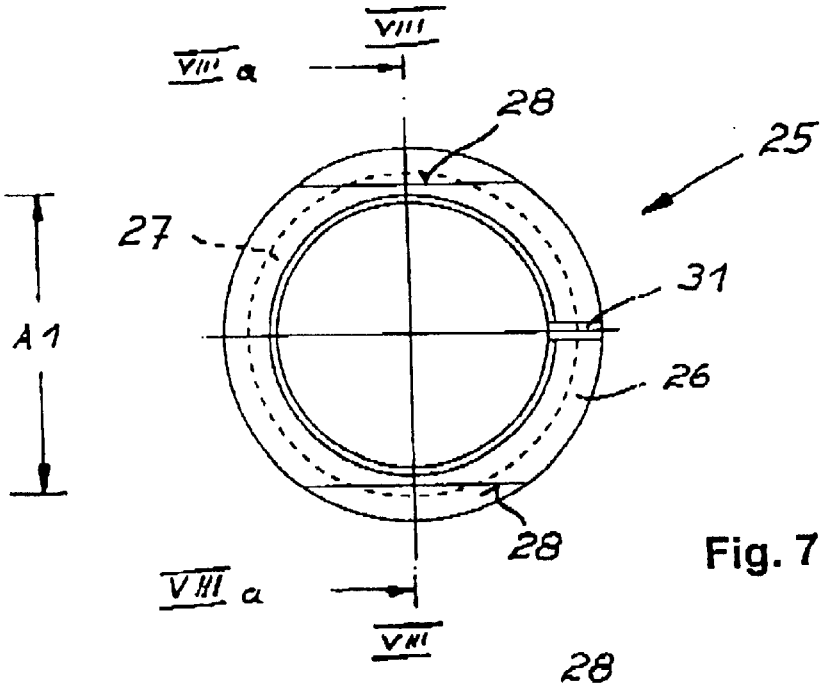
FIG. 7 shows an enlarged top view of the pressure ring for fixing the position of a piston shoe.
Figure 8:
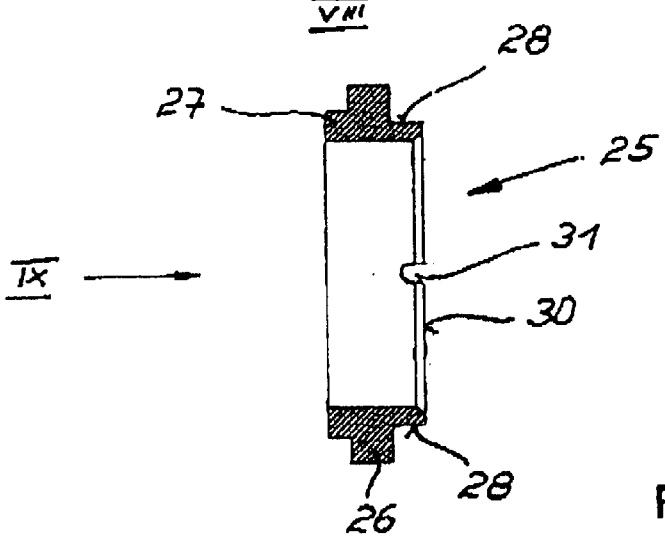
FIG. 8 is a cross-sectional view taken along the line VIII—VIII of FIG. 7 as viewed in the direction of arrows VIIIa.
Figure 9:
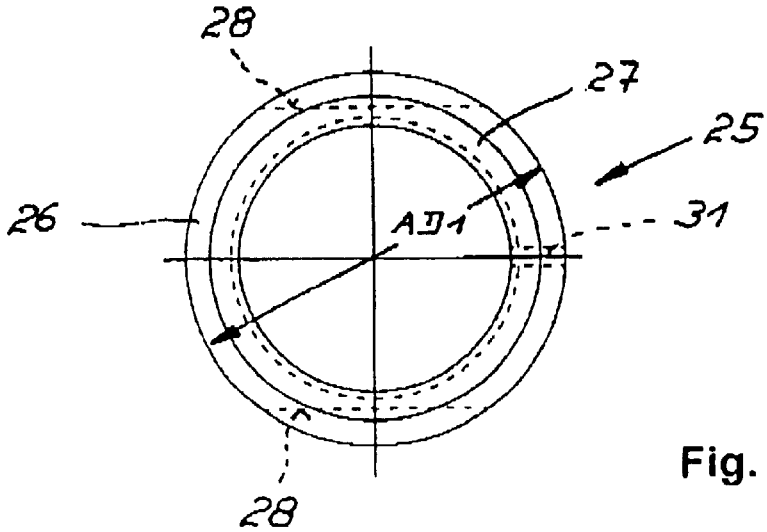
FIG. 9 is a top view of the pressure ring of FIG. 8 as viewed in the direction of arrow IX.

As seen more clearly in FIGS. 7 to 9, the position of the piston shoes 7, 7*a* on the support ring 4 can be secured by using pressure rings 25.

The pressure rings 25 have circumferential shoulders 26 and axial connecting pieces 27 projecting from the circumferential shoulders 26. The diameter AD1 of the circumferential shoulders 26 is smaller than the width B of the support ring 4, but greater than the distance D between two opposing support rails 9. The circumferential shoulders 26 have parallel flat surfaces 28 that are spaced apart by a distance A1 which is identical to the distance D between two opposing support rails 9 when a joint clearance is taken into account. Moreover, transverse grooves are provided in the end faces 30 of the circumferential shoulders 26.

During assembly, the piston shoes 7 are initially connected with the pistons 6. This can be accomplished according to the embodiment depicted in FIG. 5 or FIG. 6.

The pistons 6 and the piston shoes 7 are then inserted through the bores 32 provided in the pump housing 33 for the guide bushings 34 (see FIG. 1), so that the flat surfaces 11 on the side of the radial flanges 14 are aligned parallel to the support rails 9. In this way, the piston shoes 7 can be inserted until they make contact with a support surfaces 5. Subsequently, by using a suitability constructed assembly tool, the piston shoes 7 are rotated by 90°, causing the radial flanges 14 to engage the support rails 9 from behind, as seen clearly in FIG. 1.

The outside diameter AD of the guide bushings 34 is greater than the diameter D1 of the radial flanges 14 and also greater than the outside diameter AD1 of the pressure rings 25.

The pressure rings 25 are then inserted through the ring gaps between the piston 6 and the bores 32 in such a way that the flat surfaces 28 on the circumferential shoulders 26 are aligned parallel to the support rails 9. The flat surfaces 26 hereby engage between the connecting pieces 13 of the piston shoes 7 and the support rails 9. The pressure rings 25 are non-rotatably secured on the support ring 4. The transverse grooves 31 thereby engage with the attachment pins 24 inserted into the bores 23 on the piston shoes 7. The non-rotatably installed pressure rings 25 thereby also fix the position of the piston shoes 7 and prevent their rotation.

Subsequently, the pressure springs 75 are inserted (see FIG. 1) and centered on the axial connecting piece 27 of the pressure rings 25 facing away from the pump shaft 3 (see FIG. 8). The pressure springs 35 are also centered on the connecting piece 36 disposed on the end faces of the guide bushings 34 which are subsequently inserted into the bores 32. The operating position of the guide bushings 34 is determined by limit stops 37 disposed on the pump housing 33. Seals 38, 39 disposed between the guide bushings 34 and the pump housing 33 as well as between the pistons 6 and the guide bushings 34 ensure that the pumped fluid cannot escape from the fluid region 40 into the lubricated region 29 of the radial piston pump 1.

While the invention has been illustrated and described as embodied in a radial piston pump, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A radial piston pump, comprising:

a pump shaft supported in a housing and having an eccentric longitudinal section;

a plurality of guide bushings received in the housing;

a plurality of pistons, each piston radially extending from the pump shaft through a corresponding one of the guide bushings, whereby the pistons and the guide bushings are placed into one-to-one correspondence;

a support ring rotatably disposed on the eccentric longitudinal section of the pump shaft, the support ring having at least three mutually offset flat support faces uniformly distributed about a periphery of the support ring;

support rails disposed on the support ring;

a plurality of piston shoes, each piston shoe having a radial flange and connected with a corresponding one of the pistons, whereby the piston shoes and the pistons are placed into one-to-one correspondence, wherein the radial flanges of the piston shoes engage from behind the support rails; and spring-supported pressure rings securing the position of the piston shoes on the support ring so as to prevent rotation therebetween, wherein the guide bushing has an outside diameter that is greater than a diameter of the radial flanges and greater than an outside diameter of the pressure rings.

2. The radial piston pump of claim 1, wherein the support rails have mutually parallel top surfaces and bottom surfaces and the support ring has two peripheral edge ribs, with the support rails being arranged on an inside portion of the peripheral edge ribs.

3. The radial piston pump of claim 1, wherein the radial flange of each piston shoe has two mutually parallel opposing flat surfaces which are spaced apart from one another by a distance that is smaller than a distance between two opposing support rails.

4. The radial piston pump of claim 1, wherein the pressure rings include circumferential shoulders which have a diameter that is smaller than a width of the support ring, but greater than a spacing between two opposing support rails.

5. The radial piston pump of claim 4, wherein the circumferential shoulders of the pressure rings have opposing mutually parallel flat surfaces with a spacing therebetween that is equal to the spacing between two opposing support rails when taking into account a joining clearance.

6. The radial piston pump of claim 5, further comprising radially extending attachment pins secured in the piston shoes adjacent to the radial flanges, wherein the circumferential shoulders include end faces facing the pump shaft and provided with transverse grooves cooperating with the attachment pins.

7. The radial piston pump of claim 1, further comprising pressure springs disposed between the guide bushings and the pressure rings.

8. The radial piston pump of claim 1, wherein the pistons have ball-shaped heads and the piston shoes include spherical cups adapted to receive the ball-shaped heads.

* * * * *